US006790814B1

(12) United States Patent
Marin et al.

(10) Patent No.: US 6,790,814 B1
(45) Date of Patent: Sep. 14, 2004

(54) DELIVERY SYSTEM HAVING ENCAPSULATED POROUS CARRIER LOADED WITH ADDITIVES, PARTICULARLY DETERGENT ADDITIVES SUCH AS PERFUMES

(75) Inventors: Edgar Manuel Marin, Hamilton, OH (US); Jose Maria Velazquez, Naucalpan (MX); Jiten Odhavji Dihora, Cincinnati, OH (US); Roberto GarciaGonzalez, Tlalnepantla (MX); Gaurav Saini, Kobe (JP)

(73) Assignee: Procter & Gamble Company, Cincinnati, OH (US)

( * ) Notice: Subject to any disclaimer, the term of this patent is extended or adjusted under 35 U.S.C. 154(b) by 176 days.

(21) Appl. No.: 10/148,760

(22) PCT Filed: Nov. 27, 2000

(86) PCT No.: PCT/IB00/01755

§ 371 (c)(1),
(2), (4) Date: May 31, 2002

(87) PCT Pub. No.: WO01/40430

PCT Pub. Date: Jun. 7, 2001

Related U.S. Application Data

(60) Provisional application No. 60/169,024, filed on Dec. 3, 1999, now abandoned, and provisional application No. 60/208,629, filed on Jun. 1, 2000, now abandoned.

(51) Int. Cl.[7] ..... C11D 3/50; C11D 17/00

(52) U.S. Cl. ..... 510/101; 510/438; 512/4

(58) Field of Search ..... 512/4; 510/101, 510/438

(56) References Cited

U.S. PATENT DOCUMENTS

| | | | |
|---|---|---|---|
| 3,128,287 | A | 4/1964 | Berg et al. |
| 3,159,581 | A | 12/1964 | Diehl |
| 3,213,030 | A | 10/1965 | Diehl |
| 3,308,067 | A | 3/1967 | Diehl |
| 3,400,148 | A | 9/1968 | Quimby |
| 3,422,021 | A | 1/1969 | Roy |
| 3,422,137 | A | 1/1969 | Quimby |
| 3,576,760 | A | 4/1971 | Gould et al. |
| 3,635,830 | A | 1/1972 | Lamberti et al. |
| 3,723,322 | A | 3/1973 | Diehl |
| 3,835,163 | A | 9/1974 | Rapko |
| 3,923,679 | A | 12/1975 | Rapko |
| 3,985,669 | A | 10/1976 | Krummel et al. |
| 4,096,072 | A | 6/1978 | Brock et al. |
| 4,102,903 | A | 7/1978 | Crutchfield et al. |
| 4,120,874 | A | 10/1978 | Crutchfield et al. |
| 4,144,226 | A | 3/1979 | Crutchfield et al. |
| 4,152,272 | A | 5/1979 | Young |
| 4,158,635 | A | 6/1979 | Crutchfield et al. |
| 4,174,291 | A | 11/1979 | Benjamin et al. |
| 4,209,417 | A | 6/1980 | Whyte |
| 4,339,356 | A | 7/1982 | Whyte |
| 4,402,856 | A | 9/1983 | Schnoring et al. |
| 4,566,984 | A | 1/1986 | Bush |
| 4,585,642 | A | 4/1986 | Rieck |
| 4,663,071 | A | 5/1987 | Bush et al. |
| 4,664,839 | A | 5/1987 | Rieck |
| 4,950,310 | A | 8/1990 | Rieck et al. |
| 5,066,419 | A | 11/1991 | Walley et al. |
| 5,094,761 | A | 3/1992 | Trinh et al. |
| 5,336,665 | A | 8/1994 | Garner-Gray |
| 5,415,807 | A | 5/1995 | Gosselink et al. |
| 5,691,303 | A | 11/1997 | Pan et al. |

FOREIGN PATENT DOCUMENTS

| | | | |
|---|---|---|---|
| DE | 137599 | | 9/1979 |
| DE | 248508 | | 8/1987 |
| EP | 0 200 263 | B2 | 10/1995 |
| EP | 535942 | B1 | 2/1999 |
| GB | 2066839 | | 7/1981 |
| WO | WO 92/06154 | | 4/1992 |
| WO | WO 94/28107 | * | 12/1994 |
| WO | WO 97/11151 | A | 3/1997 |
| WO | WO 97/34982 | | 9/1997 |
| WO | WO 98/41607 | | 9/1998 |
| WO | WO 98/42818 | * | 10/1998 |
| WO | WO 99/55819 | A | 11/1999 |

* cited by examiner

*Primary Examiner*—John R. Hardee
(74) *Attorney, Agent, or Firm*—James F. McBride; Kim W. Zerby; Steve W. Miller

(57) ABSTRACT

The present invention relates to particles that may be used to deliver materials, including but not limited to, laundry additives such as perfume materials; and detergent composition that contain such particles.

13 Claims, 1 Drawing Sheet

DELIVERY SYSTEM HAVING ENCAPSULATED POROUS CARRIER LOADED WITH ADDITIVES, PARTICULARLY DETERGENT ADDITIVES SUCH AS PERFUMES

CROSS REFERENCE TO RELATED APPLICATIONS

This Application claims the benefit of PCT International Application Ser. No. PCT/IB00/01755, filed Nov. 27, 2000, which claims the benefit of U.S. Provisional Application Ser. No. 60/169,024 filed on Dec. 3, 1999, (now abandoned); and U.S. Provisional Application No. 60/208,629, filed on Jun. 1, 2000, (now abandoned).

FIELD OF THE INVENTION

The present invention relates to delivery particles, particularly to particles for the delivery of laundry additives, such as perfume agents, and detergent compositions including the delivery particles, especially granular detergents.

BACKGROUND OF THE INVENTION

Most consumers have come to expect scented laundry products and to expect that fabrics which have been laundered also have a pleasing fragrance. In many parts of the world handwashing is the predominant means of laundering fabrics. When handwashing soiled fabrics the user often comes in contact with the wash solution and is in close proximity to the detergent product used therein. Handwash solutions may also develop an offensive odor upon addition of soiled clothes. Therefore, it is desirable and commercially beneficial to add perfume materials to such products. Perfume additives make laundry compositions more aesthetically pleasing to the consumer, and in some cases the perfume imparts a pleasant fragrance to fabrics treated therewith. However, the amount of perfume carryover from an aqueous laundry bath onto fabrics is often marginal. Industry, therefore, has long searched for an effective perfume delivery system for use in detergent products which provides long-lasting, storage-stable fragrance to the product, as well as releases fragrance during use to mask wet solution odor and delivers fragrance to the laundered fabrics.

Further, after drying fabrics under the sun, fabrics obtain a "sun dried type" of odor. Consumers often prefer this to a standard perfume odor. Also they often consider fabrics with these odors to be cleaner. Because consumers like the odor, they like to dry fabrics under the sun. In some countries, however, consumers cannot dry their fabrics outside because the air is not clean, or there is too much rain. As a result, they have to dry their fabrics indoors and cannot expect to enjoy this benefit of having a "sun-dried type" of odor on their fabrics.

A detergent composition comprising a perfume which can provide a "sun-dried type" of odor has now been found.

Laundry and other fabric care compositions which contain perfume mixed with or sprayed onto the compositions are well known from commercial practice. Because perfumes are made of a combination of volatile compounds, perfume can be continuously emitted from simple solutions and dry mixes to which the perfume has been added. Various techniques have been developed to hinder or delay the release of perfume from compositions so that they will remain aesthetically pleasing for a longer length of time. To date, however, few of the methods deliver significant fabric odor benefits after prolonged storage of the product.

Moreover, there has been a continuing search for methods and compositions which will effectively and efficiently deliver perfume from a laundry bath onto fabric surfaces. As can be seen from the following disclosures, various methods of perfume delivery have been developed involving protection of the perfume through the wash cycle, with release of the perfume onto fabrics. U.S. Pat. No. 4,096,072, Brock et al, issued Jun. 20, 1978, teaches a method for delivering fabric conditioning agents, including perfume, through the wash and dry cycle via a fatty quaternary ammonium salt. U.S. Pat. No. 4,402,856, Schnoring et al, issued Sep. 6, 1983, teaches a microencapsulation technique which involves the formulation of a shell material which will allow for diffusion of perfume out of the capsule only at certain temperatures. U.S. Pat. No. 4,152,272, Young, issued May 1, 1979, teaches incorporating perfume into waxy particles to protect the perfume through storage in dry compositions and through the laundry process. The perfume assertedly diffuses through the wax on the fabric in the dryer. U.S. Pat. No. 5,066,419, Walley et al, issued Nov. 19, 1991, teaches perfume dispersed with a water-insoluble nonpolymeric carrier material and encapsulated in a protective shell by coating with a water-insoluble friable coating material. U.S. Pat. No. 5,094,761, Trinh et al, issued Mar. 10, 1992, teaches a perfume/cyclodextrin complex protected by clay which provides perfume benefits to at least partially wetted fabrics.

Another method for delivery of perfume in the wash cycle involves combining the perfume with an emulsifier and water-soluble polymer, forming the mixture into particles, and adding them to a laundry composition, as is described in U.S. Pat. No. 4,209,417, Whyte, issued Jun. 24, 1980; U.S. Pat. No. 4,339,356, Whyte, issued Jul. 13, 1982; and U.S. Pat. No. 3,576,760, Gould et al, issued Apr. 27, 1971. However, even with the substantial work done by industry in this area, a need still exists for a simple, more efficient and effective perfume delivery system which can be mixed with laundry compositions to provide initial and lasting perfume benefits to fabrics which have been treated with the laundry product.

The perfume can also be adsorbed onto a porous carrier material, such as a polymeric material, as described in U.K. Pat. Pub. 2,066,839, Bares et al, published Jul. 15, 1981. Perfumes have also been adsorbed onto a clay or zeolite material which is then admixed into particulate detergent compositions. Generally, the preferred zeolites have been Type A or 4A Zeolites with a nominal pore size of approximately 4 Angstrom units. It is now believed that with Zeolite A or 4A, the perfume is adsorbed onto the zeolite surface with relatively little of the perfume actually absorbing into the zeolite pores. While the adsorption of perfume onto zeolite or polymeric carriers may provide some improvement over the addition of neat perfume admixed with detergent compositions, industry is still searching for improvements in the length of storage time of the laundry compositions without loss of perfume characteristics, in the intensity or amount of fragrance released during the wash process and delivered to fabrics, and in the duration of the perfume scent on the treated fabric surfaces.

Combinations of perfumes generally with larger pore size zeolites X and Y are also taught in the art. East German Patent Publication No. 248,508, published Aug. 12, 1987 relates to perfume dispensers (e.g., an air freshener) containing a faujasite-type zeolite (e.g, zeolite X and Y) loaded with perfumes. The critical molecular diameters of the perfume molecules are said to be between 2–8 Angstroms. Also, East German Patent Publication No. 137,599, published Sep. 12, 1979 teaches compositions for use in powdered washing agents to provide thermoregulated release of perfume. Zeolites A, X and Y are taught for use in these compositions. These earlier teachings are repeated in the more recently filed European applications Publication No. 535,942, published Apr. 7, 1993, and Publication No. 536, 942, published Apr. 14, 1993, by Unilever PLC, and U.S. Pat. No. 5,336,665, issued Aug. 9, 1994 to Garner-Gray et al.

Effective perfume delivery compositions are taught by WO 94/28107, published Dec. 8, 1994 by The Procter & Gamble Company. These compositions comprise zeolites having pore size of at least 6 Angstroms (e.g., Zeolite X or Y), perfume releaseably incorporated in the pores of the zeolite, and a matrix coated on the perfumed zeolite, the matrix comprising a water-soluble (wash removable) composition comprising from 0% to about 80%, by weight, of at least one solid polyol containing more than 3 hydroxyl moieties and from about 20% to about 100%, by weight, of a fluid diol or polyol, in which the perfume is substantially insoluble and in which the solid polyol is substantially soluble.

Other perfume delivery systems are taught by WO 97/34982 and WO 98/41607, published by The Procter & Gamble. WO 97/34982 discloses particles comprising perfume loaded zeolite and a release barrier, which is an agent derived from a wax and having a size (i.e., a cross-sectional area) larger than the size of the pore openings of the zeolite carrier. WO 98/41607 discloses glassy particles comprising agents useful for laundry or cleaning compositions and a glass derived from one or more of at least partially-water-soluble hydroxylic compounds. A preferred agent is a perfume in a zeolite carrier.

Another problem that may occur in providing perfumed products is the excessive odor intensity associated with the products. A need therefore exists for a perfume delivery system which provides satisfactory perfume odor during use and thereafter from the dry laundered fabric, but which also provides prolonged storage benefits and reduced product odor intensity.

By the present invention it has now been discovered that perfume loaded into porous carriers such as zeolite particles, can be effectively protected from premature release of perfume by coating said loaded carrier particles with a hydrophobic oil and thereafter encapsulating the oil-coated perfume-loaded carrier particles with a water-soluble or water-dispersible, but oil-insoluble, material, such as starch or modified starch. The porous carrier may be selected to be substantive to fabrics to be able to deposit enough perfume on the fabrics to deliver a noticeable odor benefit even after the fabrics are dry.

The present invention solves the long-standing need for a simple, effective, storage-stable perfume delivery system which provides consumer-noticeable odor benefits during and after the laundering process, and which has reduced product odor during storage of the composition. In particular, fabrics treated by the present perfume delivery system have higher scent intensity and remain scented for longer periods of time after laundering and drying.

The present invention also provides a delivery system for other additives, which are desirably protected from release until the product comprising the additive is exposed to a wet or moist environment.

SUMMARY OF THE INVENTION

The present invention relates to a delivery system for additives, which are incorporated in a variety of consumer products, including detergents and cleaning compositions, room deodorizers, insecticidal compositions, carpet cleaners and deodorizers wherein the additive is protected from release until exposed to a wet or moist environment. Specifically, the present additive delivery system is a particle comprising a core of a porous carrier material containing an additive, such as a perfume, in its pores; a first coating of a hydrophobic oil encapsulating said core, and a second coating of a water-soluble or water ispersible, but oil-insoluble, material, such as starch or modified starch, encapsulating the hydrophobic-oil coated core. The present delivery particle can be used to deliver laundry and cleaning agents either to or through the wash cycle. A laundry additive delivery particle according to the present invention effectively delivers perfume ingredients through the wash to a fabric surface.

In traditional perfume delivery systems more than 50% of the perfume material is "lost" due to diffusion of the volatile perfume materials from the product or by dissolution in the wash, and is not delivered to the fabric surface. In the present invention, the coatings effectively entrap the perfume material loaded into the carrier core. Thus, the perfume material is delivered to the fabric surface at a higher rate through the wash than with traditional perfume delivery systems.

The porous carrier material is typically selected from zeolites, macroporous zeolites, amorphous silicates, crystalline nonlayer silicates, layer silicates, calcium carbonates, calcium/sodium carbonate double salts, sodium carbonates, clays, sodalites, alkali metal phosphates, chitin microbeads, carboxyalkylcelluloses, carboxyalkylstarches, cyclodextrins, porous starches, and mixtures thereof. Preferably the carrier material is a zeolites such as Zeolite X, Zeolite Y, and mixtures thereof.

Particularly preferred porous carriers are zeolite particles with a nominal pore size of at least about 6 Angstroms to effectively incorporate perfume into their pores. Without wishing to be limited by theory, it is believed that these zeolites provide a channel or cage-like structure in which the perfume molecules are trapped. Unfortunately, such perfumed zeolites are not sufficiently storage-stable for commercial use in granular fabric care products such as laundry detergents, particularly due to premature release of perfume upon moisture absorption. However, it has now been discovered that the perfume-loaded zeolite can first be coated with a hydrophobic oil to protect the zeolite particles by forming a protective barrier to entrap and maintain the perfume within the zeolite's pores, and thereafter encapsulating the oil-coated particle with a water-soluble or water-dispersible, but oil-insoluble, material. Thus, the perfume substantially remains within the pores of the zeolite particles. It is also believed that since the perfume is incorporated into the relatively large zeolite pores, it has better perfume retention through the laundry process than other smaller pore size zeolites in which the perfume is predominately adsorbed on the zeolite surface.

The hydrophobic oil coating can be a non-perfume oil but is preferably a perfume which can be the same as or different from the perfume oil loaded into the carrier. It is believed that when the present encapsulated particle is added to water, such as during laundering, the water-soluble or water-dispersible encapsulating material dissolves and starts to release the oil coating. When this oil coating is a perfume, the perfume notes are released from the wash solution, providing the wet odor benefit . The carrier particles loaded with perfume are released in the wash solution and deposit onto fabrics. After the fabrics are dried, perfume is released from the carrier as moisture in the atmosphere displaces the perfume contained in the pores of the carrier, providing the dry odor benefit The additive contained in the porous carrier core is preferably selected from the group consisting of perfumes, bleaches, bleach promoters, bleach activators, bleach catalysts, chelants, antiscalants, dye transfer inhibitors, photobleaches, enzymes, catalytic antibodies, brighteners, fabric-substantive dyes, antifungals, antimicrobials, insect repellents, soil release polymers, fabric softening agents, dye fixatives, pH jump systems, and mixtures thereof The preferred laundry additive to be loaded into the porous carrier material is a perfume. Preferably, the particle core is a perfume-loaded zeolite (PLZ).

The preferred encapsulating material is a starch, modified starch or starch hydrolysate while the preferred oil coating material is a perfume oil. The external encapsulating material may further include an ingredient selected from the group consisting of plasticizers, anti-agglomeration agents, and mixtures thereof.

In a further embodiment of the present invention, a laundry or cleaning detergent composition is provided. The laundry or cleaning composition comprises from about 0.001% to about 50% by weight of the composition of the laundry additive particle as described above and from about 50% to about 99.999% by weight of the composition of laundry ingredients selected from the group consisting of detersive surfactants, builders, bleaching agents, enzymes, soil release polymers, dye transfer inhibitors, fillers and mixtures thereof. Preferably, the composition includes at least one detersive surfactant and at least one builder.

Accordingly, it is an object of the present invention to provide an additive delivery particle having a core loaded with an additive, preferably a laundry additive such as a perfume, and at least two surface coatings comprising an intermediate hydrophobic oil coating and an external encapsulating coating of a water-soluble or water-dispersible material. It is another object of the present invention to provide a laundry and cleaning composition having said laundry additive particle thereon. It is a further object of the present invention to provide a laundry additive particle which can provide improved fabric odor benefits, prolong storage life capabilities, and reduce product odor intensity. These and other objects, features and advantages of the present invention will be recognizable to one of ordinary skill in the art from the following description and the appended claims.

All percentages, ratios and proportions herein are on a weight basis unless otherwise indicated. All documents cited herein are hereby incorporated by reference.

DETAILED DESCRIPTION OF THE PREFERRED EMBODIMENTS

Figure 1:
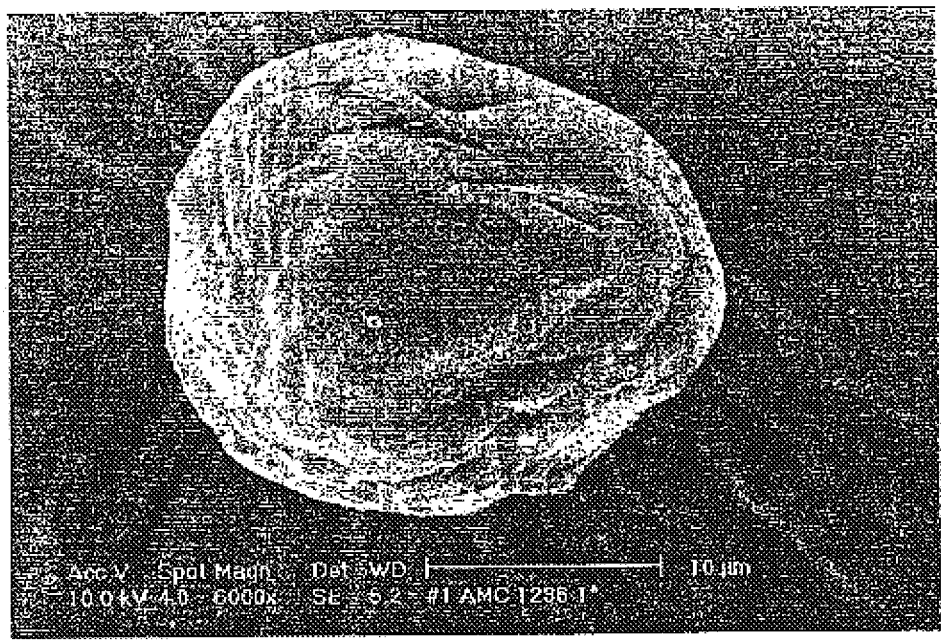
FIG. 1 shows a SEM of an intact average sized laundry additive particle comprising an encapsulated perfume-loaded zeolite particle according to the present invention.

The present invention relates to a laundry additive particle and to laundry and cleaning compositions comprising the laundry additive particle, which is preferably a perfume-containing particle. Laundry and cleaning compositions include traditional granular laundry detergents as well as granular bleach, automatic dishwashing, hard surface cleaning, and fabric softening compositions. The laundry additive particle of the present invention provides superior through the wash perfume delivery capabilities as well as minimizes product odor due to evolving volatile perfume ingredients. While not wishing to be bound by theory, it is also believed that the specified coatings of the particle of the present invention increase the stability of the particle.

The preferred laundry particle of the present invention comprises a core of a porous carrier loaded with perfume, said loaded core being first coated with a hydrophobic oil material and thereafter encapsulated with an external coating of a water-soluble or water-dispersible, but oil-insoluble, material, such as starch or modified starch, to form the final particle.

Preferably, the laundry additive particles of the present invention have a hygroscopicity value of less than about 80%. The "hygroscopicity value", as used herein, means the level of moisture uptake by the particles, as measured by the percent increase in weight of the particles under the following test method. The hygroscopicity value required for the present invention particles is determined by placing 2 grams of particles in an open container petri dish under conditions of 90° F. and 80% relative humidity for a period of 4 weeks. The percent increase in weight of the particles at the end of this time is the particles' hygroscopicity value as used herein. Preferred particles of the present invention have a hygroscopicity value of less than about 50%, more preferably less than about 30%.

The laundry additive particles of the present invention typically comprise from about 5% to about 50% of the loaded central core particle which itself is about 60% to about 99% porous carrier and about 1% to about 40% perfume or other laundry additive material, from about 1% to about 40% of hydrophobic oil intermediate coating material, and from about 10% to about 94% external encapsulating material.

Loaded Central Core Particle

As already stated, the central core of the additive particle comprises a porous carrier material and a laundry additive loaded into said carrier material. The two ingredients of the central core may be mixed in a number of different ways.

At laboratory scale, basic equipment used for this purpose can vary from a 10–20 g coffee grinder to a 100–500 g. food processor or even a 200–1000 g kitchen mixer. Procedure consists of placing the carrier material particles (zeolite) in the equipment and pouring the laundry additive at the same time that mixing occurs. Mixing time is from 0.5 to 15 minutes. The loaded carrier material (zeolite) is then allowed to rest for a period from 0.5 to 48 hours before further processing. During the loading process when heating occurs, cool jacketing may be used as an option. At pilot plant level, suitable equipment is a mixer of the Littleford type, which is a batch type mixer with plows and chopper blades that operate at high RPM's, to continuously mix the powder or mixture of powders while liquid perfume oil is being sprayed thereon.

Porous Carrier Material

The porous carrier material, as used herein, means any material capable of supporting (e.g., by adsorption into the pores) a deliverable agent such as a laundry or cleaning agent. Such materials include porous solids such as zeolites.

Preferred zeolites are selected from zeolite X, zeolite Y and mixtures thereof The term "zeolite" used herein refers to a crystalline alumninosilicate material. The structural formula of a zeolite is based on the crystal unit cell, the smallest unit of structure represented by $$Mm/n[(AlO2)m(SiO2)y].xH2O$$

where n is the valence of the cation M, x is the number of water molecules per unit cell, m and y are the total number of tetrahedra per unit cell, and y/m is 1 to 100. Most preferably, y/m is 1 to 5. The cation M can be Group IA and Group IIA elements, such as sodium, potassium, magnesium, and calcium.

A zeolite useful herein is a faujasite-type zeolite, including Type X Zeolite or Type Y Zeolite, both with a pore size typically in the range of from about 4 to about 10 Angstrom units, preferably about 8 Angstrom units.

The aluminosilicate zeolite materials useful in the practice of this invention are commercially available. Methods for producing X and Y-type zeolites are well-known and available in standard texts. Preferred synthetic crystalline alumninosilicate materials useful herein are available under the designation Type X or Type Y.

For purposes of illustration and not by way of limitation, in a preferred embodiment, the crystalline aluminosilicate material is Type X and is selected from the following:

$$Na_{86}[AlO_2]_{86}\cdot(SiO_2)_{106}]\cdot xH_2O, \quad (I)$$

$$K_{86}[AlO_2]_{86}\cdot(SiO_2)_{106}]\cdot xH_2O, \quad (II)$$

$$Ca_{40}Na_6[AlO_2]_{86}\cdot(SiO_2)_{106}]\cdot xH_2O, \quad (III)$$

$$Sr_{21}Ba_{22}[AlO_2]_{86}\cdot(SiO_2)_{106}]\cdot xH_2O, \quad (IV)$$

and mixtures thereof, wherein x is from about 0 to about 276. Zeolites of Formula (I) and (II) have a nominal pore size or opening of 8.4 Angstroms units. Zeolites of Formula (II) and (IV) have a nominal pore size or opening of 8.0 Angstroms units.

In another preferred embodiment, the crystalline aluminosilicate material is Type Y and is selected from the following(V)

$$Na_{56}[AlO_2]_{56}\cdot(SiO_2)_{136}]\cdot xH_2O, \quad (V)$$

$$K_{56}[AlO_2]_{56}\cdot(SiO_2)_{136}]\cdot xH_2O \quad (VI)$$

and mixtures thereof, wherein x is from about 0 to about 276. Zeolites of Formula (V) and (VI) have a nominal pore size or opening of 8.0 Angstroms units.

In yet another embodiment, the class of zeolites known as, "Zeolite MAP" may also be employed in the present invention. Such zeolites are disclosed and described in U.S. patent application Ser. No. 08/716,147 filed Sep. 16, 1996 and entitled, "Zeolite MAP and Alcalase for Improved Fabric Care."

Zeolites used in the present invention are in particle form having an average particle size from about 0.5 microns to about 120 microns, preferably from about 0.5 microns to about 30 microns, as measured by standard particle size analysis technique.

The size of the zeolite particles allows them to be entrained in the fabrics with which they come in contact. Once established on the fabric surface (with the coatings having been washed away during the laundry process), the zeolites can begin to release their incorporated laundry agents, especially when subjected to heat or humid conditions.

Intermediate Oil Coating Material

The intermediate oil coating material according to the present invention forms a coating on the central core particle. The intermediate coating provides a barrier to minimize release or leakage of any deliverable agent, such as a perfume, incorporated into the porous carrier. The intermediate coating material comprises a hydrophobic oil such as a perfume oil which can be the same as or different from the perfume loaded into the carrier, or a non-perfume oil, such as mineral oil. The hydrophobic oil can be one or a mixture of organic compounds, preferably having a weighted average ClogP lower than the weighted average ClogP of the additive material or mixture loaded in the pores of the carrier. ClogP values are typically used to characterize perfume ingredients, i.e., by their octanol/water partition coefficient P. The octanol/water partition coefficient of a perfume ingredient is the ratio between its equilibrium concentration in octanol and in water. The more hydrophobic a material, the higher its ClogP. The intermediate oil coating material is thus preferably less hydrophobic than the additive material contained in the porous carrier.

More preferably the highest ClogP of the material comprising the hydrophobic oil coating is lower than the lowest ClogP of the material comprising the additive loaded in the porous carrier. Even more preferably, there is a difference of at least one unit and most preferably, two units between the highest ClogP of the hydrophobic oil coating material and the lowest ClogP of the loaded additive material.

External Encapsulating Material

The external encapsulating material is coated on the intermediate coating material which is coated on the core particle and provides the outer layer of the final particle. The external coating material provides a substantially non-tacky or non-sticky coating for the final particle. Preferably, the external coating provides a particle which will have a non-tacky surface in high humidity conditions such as 80% relative humidity at 90° F.

The external coating is a material derived from one or more at least partially wash-soluble or dispersible compounds. That is, the external coating will either be soluble in an aqueous wash environment or be dispersible in that aqueous wash environment. The compounds useful herein are preferably selected from the following classes of materials.

1. Carbohydrates, which can be any or a mixture of: i) Starches including modified starches and starch hydrolysates; ii) Oligosaccharides (defined as carbohydrate chains consisting of 2–35 monosaccharide molecules); iii) Polysaccharides (defined as carbohydrate chains consisting of at least 35 monosaccharide molecules); and iv) Simple sugars (or monosaccharides); and v) hydrogenates of i), ii), iii), and iv).

Both linear and branched carbohydrate chains may be used. In addition chemically modified starches and poly-/oligo-saccharides may be used. Typical modifications include the addition of hydrophobic moieties of the form of alkyl, aryl, etc. identical to those found in surfactants to impart some surface activity to these compounds.

2. All natural or synthetic gums such as alginate esters, carrageenin, agar-agar, pectic acid, and natural gums such as gum arabic, gum tragacanth and gum karaya.
3. Chitin and chitosan.
4. Cellulose and cellulose derivatives. Examples include: i) Cellulose acetate and Cellulose acetate phthalate (CAP); ii) Hydroxypropyl Methyl Cellulose (HPMC); iii)Carboxymethylcellulose (CMC); iv) all enteric/aquateric coatings and mixtures thereof.
5. Silicates, Phosphates and Borates.
6. Water soluble polymers including polyacrylates, caprolactones, Polyvinyl alcohol (PVA) and Polyethylene glycol (PEG).

7. Waxes, including silicone waxes, paraffinic waxes, and microcrystalline waxes.
8. Plasticizers.
9. Long Chain ($C_{10}$–$C_{35}$) fatty compounds including fatty acids, fatty alcohols and fatty esters.
10. Natural proteins including gelatin, casein and egg albumin.

Materials within these classes which are not at least partially wash soluble or dispersible are useful herein only when mixed in such amounts with the compounds useful herein such that the particle produced has the preferred hygroscopicity value of less than about 80%. It is also preferred that these compounds be low temperature processable, preferably within the range of from about 50° C. to about 200° C., and more preferably within the range of from about 60° C. to about 180° C.

Preferred encapsulating materials are starches or modified starches such as CAPSUL™ commercially available from National Starch, cellulose and cellulose derivatives such as hydroxy propyl methyl cellulose, other carbohydrates such as sucrose and fructose, natural polymers such as gum arabic and guar gum, natural proteins, and water-soluble polymers such as polyethylene glycol.

The external encapsulation coating may include optional additive ingredients such as plasticizers, anti-agglomeration agents, and mixtures thereof. The optional plasticizers include sorbitol, polyethylene glycol, propylene glycol, low molecular weight carbohydrates and the like with a mixture of sorbitol and polyethylene glycol and low molecular weight polyols being the most preferred. The plasticizer is employed at levels of from about 0.01% to about 5%. The anti-agglomeration agents according to the present invention are preferably surfactants and are included at low levels of less than 1% of the external coating. Suitable surfactants for use in the present invention include TWEEN™ 80 commercially available from Imperial Chemicals, Inc. (ICI).

Laundry and Cleaning Additives

Laundry and cleaning additives or agents are included in the particle of the present invention. The agents are contained in the porous carrier material as hereinbefore described. As can be appreciated for the present invention, agents which are incorporated into the particles of the present invention may be the same as or different from those agents which are typically used to formulate the remainder of the laundry and cleaning compositions containing the particle. For example, the particle may comprise a perfume agent and (the same or different) perfume may also be blended into the final composition (such as by spray-on techniques) along with the perfume-containing particle. These agents are selected as desired for the type of composition being formulated, such as granular laundry detergent compositions, granular automatic dishwashing compositions, or hard surface cleaners.

The laundry particle of the present invention may of course be included in a composition which may contain other ingredients. The compositions containing laundry additive particles can optionally include one or more other detergent adjunct materials or other materials for assisting or enhancing cleaning performance, treatment of the substrate to be cleaned, or to modify the aesthetics of the detergent composition (e.g., perfumes, colorants, dyes, etc.).

Perfume

The preferred laundry or cleaning additive according to the present invention is a perfume material. As used herein the term "perfume" is used to indicate any odoriferous material which is subsequently released into the aqueous bath and/or onto fabrics or other surfaces contacted therewith. The perfume will most often be liquid at ambient temperatures. A wide variety of chemicals are known for perfume uses, including materials such as aldehydes, especially $C_6$–$C_{14}$ aliphatic aldehydes, $C_6$–$C_{14}$ acyclic terpene aldehydes and mixtures thereof, ketones, alcohols and esters. More commonly, naturally occurring plant and animal oils and exudates comprising complex mixtures of various chemical components are known for use as perfumes. The perfumes herein can be relatively simple in their compositions or can comprise highly sophisticated complex mixtures of natural and synthetic chemical components, all chosen to provide any desired odor. Typical perfumes can comprise, for example, woody/earthy bases containing exotic materials such as sandalwood, civet and patchouli oil. The perfumes can be of a light floral fragrance, e.g., rose extract, violet extract, and lilac. The perfumes can also be formulated to provide desirable fruity odors, e.g., lime, lemon, and orange. Any chemically compatible material which exudes a pleasant or otherwise desirable odor can be used in the perfumed compositions herein.

If "sun dried" odor is the preferred odor, the perfume component is selected from the group consisting of $C_6$–$C_{14}$ aliphatic aldehydes, $C_6$–$C_{14}$ acyclic terpene aldehyde and mixtures thereof. Preferably, the perfume component is selected from $C_8$–$C_{12}$ aliphatic aldehydes, $C_8$–$C_{12}$ acyclic terpene aldehydes and mixtures thereof. Most preferably, the perfume component is selected from the group consisting of citral; neral; iso-citral; dihydro citral; citronellal; octanal; nonanal; decanal; undecanal; dodecanal; tridecanal; 2-methyl decanal; methyl nonyl acetaldehyde; 2-nonen-1-al; decanal; undecenal; undecylenic aldehyde; 2, 6 dimethyl octanal; 2, 6, 10-trimethyl-9-undecen-1-al; trimethyl undecanal; dodecenal; melonal; 2-methyl octanal; 3, 5, 5, trimethyl hexanal and mixtures thereof. The preferable mixtures are, for example, a mixture comprising 30% by weight of 2-nonen-1-al, 40% by weight of undecylenic aldehyde and 30% by weight of citral or a mixture comprising 20% by weight of methyl nonyl acetaldehyde, 25% by weight of lauric aldehyde, 35% by weight of decanal and 20% by weight of 2-nonen-1-al.

By selecting a perfume component from among the foregoing, a "sun dried odor" is produced on the fabric even though the fabric is not actually dried in the sun. The "sun dried" odor is formed by selecting aldehydes such that at least one of them is present naturally in cotton fabrics after the fabric is dried in the sun and thus, are a component of the sun dried odor.

Perfumes also include pro-fragrances such as acetal pro-fragrances, ketal pro-fragrances, ester pro-fragrances (e.g., digeranyl succinate), hydrolyzable inorganic-organic pro-fragrances, and mixtures thereof. These pro-fragrances may release the perfume material as a result of simple hydrolysis, or may be pH-change-triggered pro-fragrances (e.g., pH drop) or may be enzymatically releasable pro-fragrances.

Preferred perfume agents useful herein are defined as follows.

For purposes of the present invention, perfume agents are those which have the ability to be incorporated into the pores of the carrier, and hence their utility as components for delivery from the carrier through an aqueous environment. Commonly-owned WO 98/41607 describes the characteristic physical parameters of perfume molecules which affect their ability to be incorporated into the pores of a carrier, such as a zeolite. Obviously for the present invention compositions whereby perfume agents are being delivered by the compositions, sensory perception is also required for a benefit to be seen by the consumer. For the present invention perfume delivery particles, the preferred perfume agents have a threshold of noticeability (measured as odor detection thresholds ("ODT") under carefully controlled GC conditions as described in detail hereinafter) less than or equal to 50 parts per billion ("ppb"). Agents with ODTs above 50 ppb up to 1 part per million ("ppm") are less preferred Agents with ODTs above 1 ppm are preferably avoided. Laundry agent perfume mixtures useful for the present invention perfume delivery particles preferably comprise from about 0% to about 80% of deliverable agents with ODTs above 50 ppb up to 1 ppm, and from about 20% to about 100% (preferably from about 30% to about 100%; more preferably from about 50% to about 100%) of deliverable agents with ODTs less than or equal to 50 ppb.

Also preferred are perfumes carried through the laundry process and thereafter released into the air around the dried fabrics (e.g., such as the space around the fabric during storage). This requires movement of the perfume out of the zeolite pores with subsequent partitioning into the air around the fabric. Preferred perfume agents are therefore further identified on the basis of their volatility. Boiling point is used herein as a measure of volatility and preferred materials have a boiling point less than 300° C. Laundry agent perfume mixtures useful for the present invention laundry particles preferably comprise at least about 50% of deliverable agents with boiling point less than 300° C. (preferably at least about 60%; more preferably at least about 70%).

In addition, preferred perfume delivery particles herein for use in laundry detergents comprise compositions wherein at least about 80%, and more preferably at least about 90%, of the deliverable perfume agents have a weighted average ClogP value ranging from about 1.0 to 16, and more preferably from about 2.0 to about 8.0. Most preferably, the deliverable perfume agents or mixtures have a weighted average ClogP value between 3 and 4.5. While not wishing to be bound by theory, it is believed that perfume materials having the preferred ClogP values are sufficiently hydrophobic to be held inside the pores of the zeolite carrier and deposited onto fabrics during the wash, yet are able to be released from the zeolite pores at a reasonable rate from dry fabric to provide a noticeable benefit. ClogP values are obtained as follows.

Calculation of ClogP:

These perfume ingredients are characterized by their octanol/water partition coefficient P. The octanol/water partition coefficient of a perfume ingredient is the ratio between its equilibrium concentration in octanol and in water. Since the partition coefficients of most perfume ingredients are large, they are more conveniently given in the form of their logarithm to the base 10, logP.

The logP of many perfume ingredients has been reported; for example, the Pomona92 database, available from Daylight Chemical Information Systems, Inc. (Daylight CIS), contains many, along with citations to the original literature.

However, the logP values are most conveniently calculated by the "CLOGP" program, also available from Daylight CIS. This program also lists experimental logP values when they are available in the Pomona92 database. The "calculated logP" (ClogP) is determined by the fragment approach of Hansch and Leo (cf., A. Leo, in Comprehensive Medicinal Chemistry, Vol. 4, C. Hansch, P. G. Sammens, J. B. Taylor and C. A. Ramsden, Eds., p. 295, Pergamon Press, 1990). The fragment approach is based on the chemical structure of each perfume ingredient and takes into account the numbers and types of atoms, the atom connectivity, and chemical bonding. The ClogP values, which are the most reliable and widely used estimates for this physicochemical property, can be used instead of the experimental logP values in the selection of perfume ingredients.

Determination of Odor Detection Thresholds:

The gas chromatograph is characterized to determine the exact volume of material injected by the syringe, the precise split ratio, and the hydrocarbon response using a hydrocarbon standard of known concentration and chain-length distribution. The air flow rate is accurately measured and, assuming the duration of a human inhalation to last 0.2 minutes, the sampled volume is calculated. Since the precise concentration at the detector at any point in time is known, the mass per volume inhaled is known and hence the concentration of material. To determine whether a material has a threshold below 10 ppb, solutions are delivered to the sniff port at the back-calculated concentration. A panelist sniffs the GC effluent and identifies the retention time when odor is noticed. The average over all panelists determines the threshold of noticeability.

The necessary amount of analyte is injected onto the column to achieve a 10 ppb concentration at the detector Typical gas chromatograph parameters for determining odor detection thresholds are listed below.

GC: 5890 Series II with FID detector
7673 Autosampler
Column: J&W Scientific DB-1
Length 30 meters ID 0.25 mm film thickness 1 micron
Method:
Split Injection: 17/1 split ratio
Autosampler: 1.13 microliters per injection
Column Flow: 1.10 mL/minute
Air Flow: 345 mL/minute
Inlet Temp. 245° C.
Detector Temp. 285° C.
Temperature Information
Initial Temperature: 50° C.
Rate: 5C/minute
Final Temperature: 280° C.
Final Time: 6 minutes
Leading assumptions: (i) 0.02 minutes per sniff
(ii) GC air adds to sample dilution Particularly preferred perfumes for use in the present invention are those perfumes referred to as high impact perfumes and characterized by having:

(1) a standard B.P. of about 275° C. or lower at 760 mm Hg, and;
(2) a ClogP, or an experimental logP, of about 2 or higher, and;
(3) an ODT of less than or equal to 50 ppb and greater than 10 ppb, Perfume Fixative Optionally, the perfume can be combined with a perfume fixative. The perfume fixative materials employed herein are characterized by several criteria which make them especially suitable in the practice of this invention. Dispersible, toxicologically-acceptable, non-skin irritating, inert to the perfume, degradable and/or available from renewable resources, and relatively odorless additives are used. Perfume fixatives are believed to slow the evaporation of more volatile components of the perfume.

Examples of suitable fixatives include members selected from the group consisting of diethyl phthalate, musks, and mixtures thereof. If used, the perfume fixative comprises from about 10% to abut 50%, preferably from about 20% to about 40%, by weight, of the perfume.

Incorporation of Perfume in Preferred Zeolite Carrier

The Type X or Type Y Zeolites to be used as the preferred carrier herein preferably contain less than about 15% desorbable water, more preferably less than about 8% desorbable water, and most preferably less than about 5% desorbable water. Such materials may be obtained by first activating/dehydrating by heating to about 150 to 350° C., optionally with reduced pressure (from about 0.001 to about 20 Torr). After activation, the agent is slowly and thoroughly mixed with the activated zeclite and, optionally, heated to about 60° C. or up to about 2 hours to accelerate absorption equilibrium within the zeolite particles. The perfume/zeolite mixture is then cooled to room temperature and is in the form of a free-flowing powder.

The amount of perfume or other laundry additive incorporated into the zeolite carrier is typically from 1% to 40%, preferably at least about 10%, more preferably at least about 18.5%, by weight of the loaded particle, given the limits on the pore volume of the zeolite. It is to be recognized, however, that the present invention particles may exceed this level of laundry additive by weight of the particle, but recognizing that excess levels of laundry additives will not be incorporated into the zeolite, even if only deliverable agents are used. Therefore, the present invention particles may comprise more than 40% by weight of laundry agents. Since any excess laundry agents (as well as any non-deliverable agents present) are not incorporated into the zeolite pores, these materials are likely to be immediately released to the wash solution upon contact with the aqueous wash medium.

Coating and Encapsulation of Loaded Zeolite Particles

In an embodiment of the present invention, perfume-loaded zeolite particles in the form of a free-flowing powder are thoroughly coated with a hydrophobic oil such as mineral oil or perfume oil. The hydrophobic-oil coated particles are mixed to a solution of modified starch (CAPSUL™, National Starch & Chemicals) and agitated to form an emulsion. The emulsion is then spray-dried using a spray dryer having a spraying system such as co-current with a spinning disk, with vaneless disk, with vaned disk or wheel or with two-fluid mist spray nozzle. Typical conditions involve an inlet temperature of from about 120° C. to about 220° C. and an outlet temperature of from about 50° C. to about 220° C.

Figure 2:
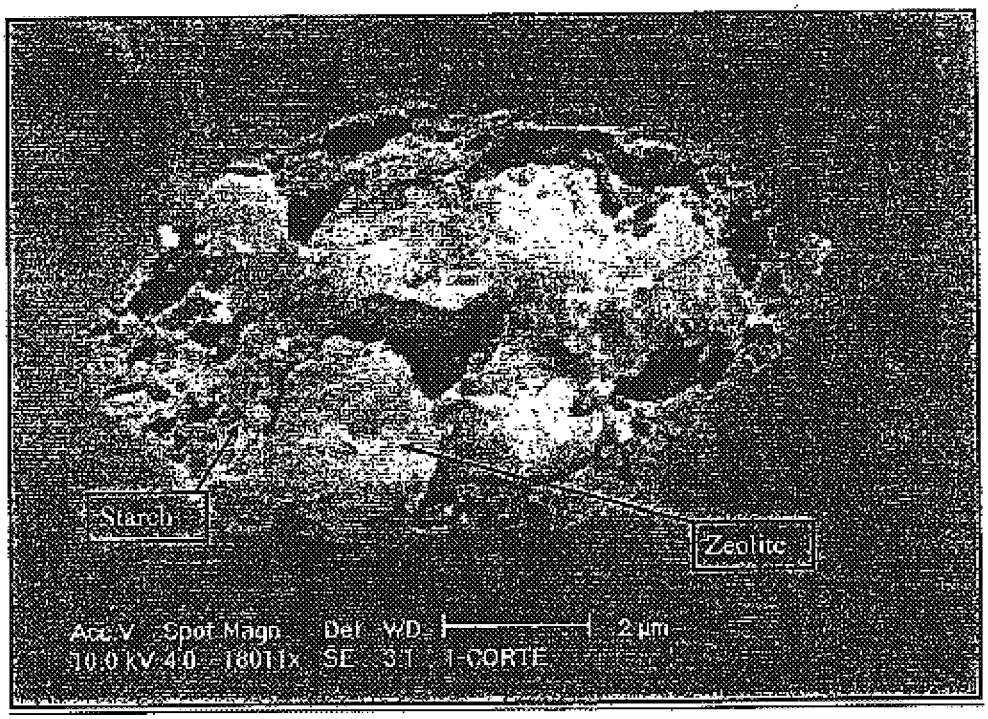
FIG. 2 shows a SEM of a cross-section of a particle according to the present invention, containing loaded zeolite particles inside a starch coating.

The present laundry additive delivery particles are discrete particles having particle size of from about 3 to about 100 microns as measured by standard particle size analysis technique. FIG. 1 shows a SEM of an intact average sized encapsulated perfume-loaded zeolite particle according to the present invention. FIG. 2 shows a cross-section of a particle according to the present invention, containing loaded zeolite particles inside a starch coating.

Stability Testing of Encapsulated Perfume-Loaded Zeolite Particles

Samples of encapsulated perfume-loaded zeolite particles are kept in open jars at 80° F. and 70% Relative Humidity and in sealed plastic bags at 120° F. for ten days. After that period the samples are taken out and evaluated organoleptically. Particles are homogenized and dosed according to regional real washing conditions. They are mixed with odorless base granule, previously approved for this kind of test. Original particles (which are not subjected to stability testing conditions) are included as reference. Perfume intensity scores for the particles are registered in terms of Dry Fabric Odor. Particles with perfume loaded zeolite arc able to provide between 5 points to 20 points of advantage, in a perfume intensity scale, compared against control with sprayed on perfume alone.

Adjunct Laundry or Cleaning Ingredients

Adjunct ingredients useful in the laundry or cleaning compositions according to the present invention include surfactants, builders, and agents such as those which are incorporated into the present delivery particles. The various types of agents useful in laundry and cleaning compositions are described hereinafter. The compositions containing particulate compositions can optionally include one or more other detergent adjunct materials or other materials for assisting or enhancing cleaning performance, treatment of the substrate to be cleaned, or to modify the aesthetics of the detergent composition.

Detersive Surfactant

The granules and/or the agglomerates include surfactants at the levels stated previously. The detersive surfactant can be selected from the group consisting of anionic surfactants, nonionic surfactants, cationic surfactants, zwitterionic surfactants and mixtures. Nonlimiting examples of surfactants useful herein include the conventional $C_{11}$–$C_{18}$ alkyl benzene sulfonates ("LAS") and primary, branched-chain and random $C_{10}$–$C_{20}$ alkyl sulfates ("AS"), the $C_{10}$–$C_{18}$ secondary (2,3) alkyl sulfates of the formula $CH_3(CH_2)_x(CHOSO_3^-M^+)$ $CH_3$ and $CH_3$ $(CH_2)_y(CHOSO_3^-M^+)$ $CH_2CH_3$ where x and (y+1) are integers of at least about 7, preferably at least about 9, and M is a water-solubilizing cation, especially sodium, unsaturated sulfates such as oleyl sulfate, the $C_{10}$–$C_{18}$ alkyl alkoxy sulfates ("$AE_xS$"; especially EO 1–7 ethoxy sulfates), $C_{10}$–$C_{18}$ alkyl alkoxy carboxylates (especially the EO 1–5 ethoxycarboxylates), the $C_{10-C18}$ glycerol ethers, the $C_{10}$–$C_{18}$ alkyl polyglycosides and their corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the overall compositions. The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Mixtures of anionic and nonionic surfactants are especially useful. Other conventional useful surfactants are listed in standard texts.

The $C_{10}$–$C_{18}$ alkyl alkoxy sulfates ("$AE_xS$"; especially EO 1–7 ethoxy sulfates) and $C_{12}$–$C_{18}$ alkyl ethoxylates ("AE") are the most preferred for the cellulase-containing detergents described herein.

Detersive Builder

The granules and agglomerates preferably include a builder at the previously stated levels. To that end, inorganic as well as organic builders can be used. Also, crystalline as well as amorphous builder materials can be used. Builders are typically used in fabric laundering compositions to assist in the removal of particulate soils and to eliminate water hardness.

Inorganic or P-containing detergent builders include, but are not limited to, the alkali metal, ammonium and alkanolammonium salts of polyphosphates (exemplified by the tripolyphosphates, pyrophosphates, and glassy polymeric meta-phosphates), phosphonates, phytic acid, silicates, carbonates (including bicarbonates and sesquicarbonates), sulphates, and alumninosilicate. However, non-phosphate builders are required in some locales. Importantly, the compositions herein function surprisingly well even in the presence of the so-called "weak" builders (as compared with phosphates) such as citrate, or in the so-called "under built" situation that may occur with zeolite or layered silicate builders.

Examples of silicate builders are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839, issued May 12, 1987 to H. P. Rieck NaSKS-6 is the trademark for a crystalline layered silicate marketed by Hoechst (commonly abbreviated herein as "SKS-6"). Unlike zeolite builders, the Na SKS-6 silicate builder does not contain aluminum. NaSKS-6 has the delta-$Na_2SiO_5$ morphology form of layered silicate. It can be prepared by methods such as those described in German DE-A-3,417,649 and DE-A-3,742,043. SKS-6 is a highly preferred layered silicate for use herein, but other such layered silicates, such as those having the general formula $NaMSi_xO_{2x+1}\cdot yH_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-11, as the alpha, beta and gamma form is. As noted above, the delta-$Na_2SiO_5$ (NaSKS-6 form) is most preferred for use herein. Other silicates may also be useful such as for example magnesium silicate, which can serve as a crispening agent in granular formulations, as a stabilizing agent for oxygen bleaches, and as a component of suds control systems.

Examples of carbonate builders are the alkaline earth and alkali metal carbonates as disclosed in German Patent Application No. 2,321,001 published on Nov. 15, 1973. As mentioned previously, aluminosilicate builders are useful builders in the present invention. Aluminosilicate builders are of great importance in most currently marketed heavy duty granular detergent compositions, and can also be a significant builder ingredient in liquid detergent formulations. Aluminosilicate builders include those having the empirical formula:

$$M_z(zAlO_2)_y]\cdot xH_2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al, issued Oct. 12, 1976. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula:

$$Na_{12}[(AlO_2)_{12}(SiO_2)_{12}]\cdot xH_2O$$

wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt. When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in Berg, U.S. Pat. No. 3,128,287, issued Apr. 7, 1964. and Lamberti et al, U.S. Pat. No. 3,635,830. issued Jan. 18, 1972. See also "TMS/TDS" builders of U.S. Pat. No. 4,663,071, issued to Bush et al, on May 5, 1987. Suitable ether polycarboxylates also include cyclic compounds, particularly alicyclic compounds, such as those described in U.S. Pat. Nos. 3,923,679; 3,835,163; 4,158,635; 4,120,874 and 4,102,903.

Other useful detergency builders include the ether hydroxypolycarboxylates, copolymers of maleic anhydride with ethylene or vinyl methyl ether, 1, 3, 5-trihydroxy benzene-2, 4, 6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance for heavy duty liquid detergent formulations due to their availability from renewable resources and their biodegradability. Citrates can also be used in granular compositions, especially in combination with zeolite and/or layered silicate builders. Oxydisuccinates are also especially useful in such compositions and combinations.

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986. Useful succinic acid builders include the $C_5$–$C_{20}$ allyl and alkenyl succinic acids and salts thereof. A particularly preferred compound of this type is dodecenylsuccinic acid Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Other suitable polycarboxylates are disclosed in U.S. Pat. No. 4,144,226, Crutchfield et al, issued Mar. 13, 1979 and in U.S. Pat. No. 3,308,067, Diehl, issued Mar. 7, 1967. See also Diehl U.S. Pat. No. 3,723,322.

Fatty acids, e.g., $C_{12}$–$C_{18}$ monocarboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

In situations where pbosphorus-based builders can be used, and especially in the formulation of bars used for hand-laundering operations, the various alkali metal phosphates such as the well-known sodium tripolyphosphates, sodium pyrophosphate and sodium orthophosphate can be used. Phosphqnate builders such as ethane 1 hydroxy-1,1-diphosphonate and other known phosphonates (see, for example, U.S. Pat. Nos. 3,159,581; 3,213,030; 3,422,021; 3,400,148 and 3,422,137) can also be used.

Other Adjunct Ingredients

The composition of the present invention may also include enzymes, enzyme stabilizers, brighteners, polymeric dispersing agents (i.e. polyacrylates), carriers, hydrotropes, suds boosters or suppressors, soil release agents, dye transfer inhibitors, and processing aids.

Granular Compositions

The laundry and cleaning compositions of the present invention can be used in both low density (below 550 grams/liter) and high density granular compositions in which the density of the granule is at least 550 grams/liter. Granular compositions are typically designed to provide an in the wash pH of from about 7.5 to about 11.5, more preferably from about 9.5 to about 10.5. Low density compositions can be prepared by standard spray-drying processes. Various means and equipment are available to prepare high density compositions. Current commercial practice in the field employs spray-drying towers to manufacture compositions which have a density less than about 500 g/l. Accordingly, if spray-drying is used as part of the overall process, the resulting spray-dried particles must be further densified using the means and equipment described hereinafter. In the alternative, the formulator can eliminate spray-drying by using mixing, densifying and granulating equipment that is commercially available. The following is a nonlimiting description of such equipment suitable for use herein.

Various means and equipment are available to prepare high density (i.e., greater than about 550, preferably greater than about 650, grams/liter or "g/l"), high solubility, free-flowing, granular detergent compositions according to the present invention. Current commercial practice in the field employs spray-drying towers to manufacture granular laundry detergents which often have a density less than about 500 g/l. In this procedure, an aqueous slurry of various heat-stable ingredients in the final detergent composition are formed into homogeneous granules by passage through a spray-drying tower, using conventional techniques, at temperatures of about 175° C. to about 225° C. However, if spray drying is used as part of the overall process herein, additional process steps as described hereinafter must be used to obtain the level of density (i.e., >650 g/l) required by modern compact, low dosage detergent products.

For example, spray-dried granules from a tower can be densified further by loading a liquid such as water or a nonionic surfactant into the pores of the granules and/or subjecting them to one or more high speed mixer/densifiers. A suitable high speed mixer/densifier for this process is a device marketed under the tradename "Lödige CD 30" or "Le, ödige CB 30 Recycler" which comprises a static cylindrical mixing drum having a central rotating shaft with mixing/cutting blades mounted thereon. In use, the ingredients for the detergent composition are introduced into the drum and the shaft/blade assembly is rotated at speeds in the range of 100–2500 rpm to provide thorough mixing/densification. See Jacobs et al, U.S. Pat. No. 5,149,455, issued Sep. 22, 1992. The preferred residence time in the high speed mixer/densifier is from about 1 to 60 seconds. Other such apparatus includes the devices marketed under the tradename "Shugi Granulator" and under the tradename "Drais K-TTP 80).

Another process step which can be used to densify further spray-dried granules involves grinding and agglomerating or deforming the spray-dried granules in a moderate speed mixer/densifier so as to obtain particles having lower intra-particle porosity. Equipment such as that marketed under the tradename "Lödige KM" (Series 300 or 600) or "Lödige Ploughshare" mixer/densifiers are suitable for this process step. Such equipment is typically operated at 40–160 rpm. The residence time of the detergent ingredients in the moderate speed mixer/densifier is from about 0.1 to 12 minutes. Other useful equipment includes the device which is available under the tradename "Drais K-T 160". This process step which employs a moderate speed mixer/densifier (e.g. Lödige KM) can be used by itself or sequentially with the aforementioned high speed mixer/densifier (e.g. Lödige CB) to achieve the desired density. Other types of granules manufacturing apparatus useful herein include the apparatus disclosed in U.S. Pat. No. 2,306,898, to G. L. Heller, Dec. 29, 1942.

While it may be more suitable to use the high speed mixer/densifier followed by the low speed mixer/densifier, the reverse sequential mixer/densifier configuration is also contemplated by the invention. One or a combination of various parameters including residence times in the mixer/densifiers, operating temperatures of the equipment, temperature and/or composition of the granules, the use of adjunct ingredients such as liquid binders and flow aids, can be used to optimize densification of the spray-dried granules in the process of the invention. By way of example, see the processes in Appel et al, U.S. Pat. No. 5,133,924, issued Jul. 28, 1992 (granules are brought into a deformable state prior to densification); Delwel et al, U.S. Pat. No. 4,637,891, issued Jan. 20, 1987 (granulating spray-dried granules with a liquid binder and aluminosilicate); Kruse et al, U.S. Pat. No. 4,726,908, issued Feb. 23, 1988 (granulating spray-dried granules with a liquid binder and aluminosilicate); and, Bortolotti et al, U.S. Pat. No. 5,160,657, issued Nov. 3, 1992 (coating densified granules with a liquid binder and aluminosilicate).

In those situations in which particularly heat sensitive or highly volatile detergent ingredients are to be incorporated into the final detergent composition, processes which do not include spray drying towers are preferred. The formulator can eliminate the spray-drying step by feeding, in either a continuous or batch mode, starting detergent ingredients directly into mixing/densifying equipment that is commercially available. One particularly preferred embodiment involves charging a surfactant paste and an anhydrous builder material into a high speed mixer/densifier (e.g. Lödige CB) followed by a moderate speed mixer/densifier (e.g. Lödige KM) to form high density detergent agglomerates. See Capeci et al, U.S. Pat. No. 5,366,652, issued Nov. 22, 1994 and Capeci et al, U.S. Pat. No. 5,486,303, issued Jan. 23, 1996. Optionally, the liquid/solids ratio of the starting detergent ingredients in such a process can be selected to obtain high density agglomerates that are more free flowing and crisp.

Optionally, the process may include one or more recycle streams of undersized particles produced by the process which are fed back to the mixer/densifiers for further agglomeration or build-up. The oversized particles produced by this process can be sent to grinding apparatus and then fed back to the mixing/densifying equipment. These additional recycle process steps facilitate build-up agglomeration of the starting detergent ingredients resulting in a finished composition having a uniform distribution of the desired particle size (400–700 microns) and density (>550 g/l). See Capeci et al, U.S. Pat. No. 5,516,448, issued May 14, 1996 and Capeci et al, U.S. Pat. No. 5,489,392, issued Feb. 6, 1996. Other suitable processes which do not call for the use of spray-drying towers are described by Bollier et al, U.S. Pat. No. 4,828,721, issued May 9, 1989; Beerse et al, U.S. Pat. No. 5,108,646, issued Apr. 28, 1992; and, Jolicoeur, U.S. Pat. 5,178,798, issued Jan. 12,1993.

In yet another embodiment, the high density detergent composition of the invention can be produced using a fluidized bed mixer. In this process, the various ingredients of the finished composition are combined in an aqueous slurry (typically 80% solids content) and sprayed into a fluidized bed to provide the finished detergent granules. Prior to the fluidized bed, this process can optionally include the step of mixing the slurry using the aforementioned L ödige CB mixer/densifier or a "Flexomix 160" mixer/densifier, available from Shugi. Fluidized bed or moving beds of the type available under the tradename "Escher Wyss" can be used in such processes.

Another suitable process which can be used herein involves feeding a liquid acid precursor of an anionic surfactant, an alkaline inorganic material (e.g. sodium carbonate) and optionally other detergent ingredients into a high speed mixer/densifier (residence time 5–30 seconds) so as to form agglomerates containing a partially or totally neutralized anionic surfactant salt and the other starting detergent ingredients. Optionally, the contents in the high speed mixer/densifier can be sent to a moderate speed mixer/densifier (e.g. Lödige KM) for further agglomeration resulting in the finished high density detergent composition. See Appel et al, U.S. Pat. No. 5,164,108, issued Nov. 17, 1992.

Optionally, high density detergent compositions according to the invention can be produced by blending conventional or densified spray-dried detergent granules with detergent agglomerates in various proportions (e.g. a 60:40 weight ratio of granules to agglomerates) produced by one or a combination of the processes discussed herein. Additional adjunct ingredients such as enzymes, perfumes, brighteners and the like can be sprayed or admixed with the agglomerates, granules or mixtures thereof produced by the processes discussed herein. Bleaching compositions in granular form typically limit water content, for example, to less than about 7% free water, for best storage stability.

Deposition of Perfume onto Fabric Surfaces

The method of washing fabrics and depositing perfume thereto comprises contacting said fabrics with an aqueous wash liquor comprising at least about 100 ppm of conventional detersive ingredients described hereinabove, as well as at least about 0.1 ppm of the above-disclosed laundry additive particle. Preferably, said aqueous liquor comprises from about 500 ppm to about 20,000 ppm of the conventional detersive ingredients and from about 10 ppm to about 200 ppm of the laundry additive particle.

The laundry additive particle works under all circumstances, but is particularly useful for providing odor benefits during the laundering process and on wet and dry fabrics. The method comprises contacting fabrics with an aqueous liquor containing at least about 100 ppm of conventional detersive ingredients and at least about 1 ppm of the laundry additive particle such that the perfumed zeolite particles are entrained on the fabrics, storing linedried fabrics under ambient conditions with humidity of at least 20%, drying the fabric in a conventional automatic dryer, or applying heat to fabrics which have been line-dried or machine dried at low heat (less than about 50° C.) by conventional ironing means (preferably with steam or prewetting).

The following nonlimiting examples illustrate the parameters of and compositions employed within the invention. All percentages, parts and ratios are by weight unless otherwise indicated.

EXAMPLE I

Perfume-loaded zeolite ("PLZ") is prepared by mixing Zeolite 13X and perfume at a 85/15 weight ratio. The PLZ is thoroughly mixed with the intermediate coating oil (ICO) in a proportion of 1:0.5 to 1:1 PLZ:ICO. The mixture is then poured into a solution about 4 fold the weight of the mixture and containing about 25% solid starch. During the entire process, this second mixture is kept with agitation using a mixer or a high-speed homogenizer such as a tissue homogenizer. The mixture is then pumped into a spray dryer at 180° C. to 220° C. The process yields a fine powder, which is suitable for use as a laundry additive in a detergent composition. The perfume loaded in the zeolite has following composition:

| Material Name | % |
|---|---|
| Violiff | 2.5 |
| Frutene | 15.0 |
| Methyl Iso Butenyl Tetrahydro Pyran | 7.5 |
| Cymal | 10.0 |
| Florhydral | 15.0 |
| Delta Damascone | 15.0 |
| Ionone Beta | 25.0 |
| P.T. Bucinal | 10.0 |

The particles formed unexpectedly have a superior "Neat Product Odor" ("NPO") and emit only minimal detectable odors over the base product odor as observed by a statistically significant number of panelist graders. This provides strong evidence of the lack of perfume displacement from the carrier particles.

EXAMPLE II

Several detergent compositions are exemplified below incorporating the perfume particle prepared in Example I.

| | A | B | C |
|---|---|---|---|
| Base Granule | | | |
| Aluminosilicate | 18.0 | 22.0 | 24.0 |
| Sodium Sulfate | 10.0 | 19.0 | 6.0 |
| Sodium Polyacrylate Polymer | 3.0 | 2.0 | 4.0 |
| PolyethyleneGlycol (MW = 400) | 2.0 | 1.0 | — |
| $C_{12-13}$ Linear Alkylbenzene Sulfonate, Na | 6.0 | 7.0 | 8.0 |
| $C_{14-16}$ Secondary Alkyl Sulfate, Na | 3.0 | 3.0 | — |
| $C_{14-15}$ Alkyl Ethoxylated Sulfate, Na | 3.0 | 9.0 | — |
| Sodium Silicate | 1.0 | 2.0 | 3.0 |
| Brightener 24/47[1] | 0.3 | 0.3 | 0.3 |
| Sodium Carbonate | 7.0 | 26.0 | |
| Carboxymethyl Cellulose | — | — | 1.0 |
| DTPMPA[2] | — | — | 0.5 |
| DTPA[3] | 0.5 | — | — |
| Admixed Agglomerates | | | |
| $C_{14-15}$ Alkyl Sulfate, Na | 5.0 | — | — |
| $C_{12-13}$ Linear Alkylbenzene Sulfonate, Na | 2.0 | — | — |

-continued

| | A | B | C |
|---|---|---|---|
| Sodium Carbonate | 4.0 | — | — |
| Polyethylene Glycol (MW = 4000) | 1.0 | — | — |
| Admix | | | |
| Sodium Carbonate | — | — | 13.0 |
| $C_{12-15}$ Alkyl Ethoxylate (EO = 7) | 2.0 | 0.5 | 2.0 |
| $C_{12-15}$ Alkyl Ethoxylate (EO = 3) | — | — | 2.0 |
| Perfume Spray-On | 0.3 | 0.4 | 0.3 |
| Perfume Particles[4] | 0.5 | 0.5 | 0.5 |
| Polyvinylpyrrolidone | 0.5 | — | — |
| Polyvinylpyridine N-oxide | 0.5 | — | — |
| Polyvinylpyrrolidone-polyvinylimidazole | 0.5 | — | — |
| Distearylamine & Cumene Sulfonic Acid | 2.0 | — | — |
| Soil Release Polymer[5] | 0.5 | — | — |
| Lipolase Lipase (100,000 LU/I)[6] | 0.5 | — | 0.5 |
| Termamyl Amylase (60 KNU/g)[6] | 0.3 | — | 0.3 |
| CAREZYME ® Cellulase (1000 CEVU/g)[6] | 0.3 | — | — |
| Protease (40 mg/g)[7] | 0.5 | 0.5 | 0.5 |
| NOBS[8] | 5.0 | — | — |
| TAED[9] | — | — | 3.0 |
| Sodium Percarbonate | 12.0 | — | — |
| Sodium Perborate Monohydrate | — | — | 22.0 |
| Polydimethylsiloxane | 0.3 | — | 3.0 |
| Sodium Sulfate | — | — | 3.0 |
| Miscellaneous (water, etc.) | balance | balance | balance |
| Total | 100 | 100 | 100 |

[1]Purchased from Ciba-Geigy
[2]Diethylene Triamine PentaMethylene Phosophonic Acid
[3]Diethylene Triamine Pentaacetic Acid
[4]From Example I
[5]Made according to U.S. Pat. No. 5,415,807, issued May 16, 1995 to Gosselink, et al.
[6]Purchased from Novo Nordisk A/S
[7]Purchased from Genencor
[8]Nonanoyloxybenzenesulfonate
[9]Tetra Acetyl Ethylene Diamine

EXAMPLE III

The following detergent compositions according to the invention are suitable for machine and bandwashing operations. The base granule is prepared by a conventional spray drying process in which the starting ingredients are formed into a slurry and passed through a spray drying tower having a counter current stream of hot air (200–400 C) resulting in the formation of porous granules. The remaining adjunct detergent ingredients are sprayed on or added dry.

| | A | B | C |
|---|---|---|---|
| Base Granule | | | |
| $C_{12-13}$ Alkylbenzene Sulfonate, Na | 19.0 | 18.0 | 19.0 |
| Cationic Surfactant[1] | 0.5 | 0.5 | — |
| DTPMPA[2] | 0.3 | — | — |
| DTPA[3] | — | 0.3 | — |
| Sodium Tripolyphosphate | 25.0 | 19.0 | 29.0 |
| Acrylic/Maleic Co-polymer | 1.0 | 0.6 | — |
| Carboxymethylcellulose | 0.3 | 0.2 | 0.3 |
| Brightener 49/15/33[4] | 0.2 | 0.2 | 0.2 |
| Sodium Sulfate | 28.0 | 39.0 | 15.0 |
| Sodium Silicate (2.0R) | 7.5 | — | — |
| Sodium Silicate (1.6R) | — | 7.5 | 6.0 |

-continued

| | A | B | C |
|---|---|---|---|
| Admix | | | |
| Quantum (zinc phthalocyanine sulfonate) | 2.0 | 2.0 | 2.0 |
| Sodium Carbonate | 5.0 | 6.0 | 20.0 |
| $C_{12-13}$ Alkly Ethoxylate (EO = 7) | 0.4 | — | 1.2 |
| Savinase[5] Protease (4KNPY/g) | 0.6 | — | 1.0 |
| Termamyl[5] Amylase (60 KNU/g) | 0.4 | — | — |
| Lipolase[5] Lipase (100,000 LU/I) | 0.1 | 0.1 | 0.1 |
| Sav/Ban[5] (6 KNPU/100 KNU/g) | — | 0.3 | — |
| CAREZYME ®[5] Cellulase (1000 CEVU/g) | — | 0.1 | — |
| Soil Release Polymer[6] | 0.1 | 0.1 | 0.3 |
| Perfume Spray-On | 0.4 | 0.4 | 0.4 |
| Perfume Particles[7] | 1.5 | 1.5 | 2.0 |
| Miscellaneous (water, etc.) | balance | balance | balance |
| Total | 100.0 | 100.0 | 100.0 |

[1]C12–14Dimethyl Hydroxyethyl Quaternary Ammonium Compound
[2]Diethylene Triamine Pentamethylenephosphoric Acid
[3]Diethylene Triamine Pentaacetic Acid
[4]Purchased from Ciba-Geigy
[5]Purchased from Novo Nordisk A/S
[6]Made according to U.S. Pat. No. 5,415,807 issued May 16, 1995 to Gosselink et al
[7]From Example I

EXAMPLE IV

The following detergent composition according to the invention is in the form of a laundry bar which is particularly suitable for handwashing operations.

| | % Weight |
|---|---|
| Coconut Fatty Alkyl Sulfate | 30.0 |
| Sodium Tripolyphosphate | 5.0 |
| Tetrasodium Pyrophosphate | 5.0 |
| Sodium Carbonate | 20.0 |
| Sodium Sulfate | 5.0 |
| Calcium Carbonate | 5.0 |
| $Na_{1.9}K_{0.1}Ca(CO_3)_2$ | 15.0 |
| Aluminosilicate | 2.0 |
| Coconut Fatty Alcohol | 2.0 |
| Perfume Particle[1] | 1.0 |
| Perfume Spray-On | 1.0 |
| Miscellaneous (water, etc.) | Balance |
| Total | 100.0 |

[1]From Example I.

Having thus described the invention in detail, it will be clear to those skilled in the art that various changes may be made without departing from the scope of the invention and the invention is not to be considered limited to what is described in the specification

What is claimed is:

1. An additive delivery particle comprising:

(i) a central core particle, said core particle comprising a porous carrier material and an additive contained in the pores of said porous carrier material; said additive comprising a perfume;

(ii) an intermediate coating material coated on said central core particle, said intermediate coating material comprising a hydrophobic oil material; and (iii) an external encapsulating material coated on said intermediate coating material, said external encapsulating material providing said additive delivery particle with a substantially non-tacky surface; said external coating material comprising one or more at least partially wash soluble or dispersible compounds selected from the group consisting of carbohydrates, cellulose and cellulose derivatives, natural and synthetic gums, silicates, borates, phosphates, chitin and chitosan, water soluble polymers, fatty compounds, and mixtures thereof.

2. An additive delivery particle according to claim 1, wherein said intermediate hydrophobic oil coating material has a ClogP lower than the ClogP of the additive material contained in the porous carrier material.

3. An additive delivery particle according to claim 2 comprising:

(i) from about 5% to about 50% of said central core particle, said core particle comprising by weight of the core particle, from about 60% to about 99% porous carrier material and from about 1% to about 40% additive material;

(ii) from about 1% to about 40% said intermediate hydrophobic coating material; and (iii) from about 10% to about 94% said external encapsulating material.

4. An additive delivery particle according to claim 3 wherein said porous carrier material is a zeolite selected from the group consisting of Zeolite X, Zeolite Y, and mixtures thereof.

5. An additive delivery particle according to claim 3 wherein said additive loaded into said carrier is a perfume material.

6. An additive delivery particle according to claim 3 wherein said intermediate hydrophobic coating material is a perfume oil.

7. An additive delivery particle according to claim 3 wherein said external coating material is a carbohydrate selected from starch, modified starch or starch hydrolysate.

8. An additive delivery particle according to claim 3 comprising:

(i) from about 5% to about 50% of said central core particle, said core particle comprising by weight of the core particle from about 60% to about 99% zeolite as porous carrier material and from about 1% to about 40% perfume material;

(ii) from about 1% to about 40% perfume oil as intermediate coating material; and (iii) from about 10% to about 94% starch or modified starch as external encapsulating material.

9. An additive delivery particle according to claim 8 wherein said perfume material loaded into said zeolite carrier has a weighted average ClogP value between about 1.0 and about 16.0.

10. An additive delivery particle according to claim 8 wherein said perfume material loaded into said zeolite carrier comprises a high impact perfume characterized by having:

(1) a standard B.P. of about 275° C. or lower at 760 mm Hg, and;

(2) a ClogP, or an experimental logP, of about 2 or higher, and;

(3) an ODT of less than or equal to 50 ppb and greater than 10 ppb.

11. An additive delivery particle according to claim 8 wherein said perfume oil used as intermediate coating material comprises a high impact perfume characterized by having:

(1) a standard B.P. of about 275° C. or lower at 760 mm Hg, and;

(2) a ClogP, or an experimental logP, of about 2 or higher, and;

(3) an ODT of less than or equal to 50 ppb and greater than 10 ppb.

12. An additive delivery particle according to claim 8 comprising:

(i) from about 10% to about 40% of said central core particle;

(ii) from about 10% to about 30% perfume oil as intermediate coating material; and (iii) from about 30% to about 80% starch or modified starch as external encapsulating material.

13. A laundry or cleaning detergent composition comprising:

a) from about 0.001% to about 50% by weight of the composition of an additive delivery particle comprising:

(i) a central core particle, said core particle comprising a porous carrier material and an additive contained in the pores of said porous carrier material; said additive comprising a perfume;

(ii) an intermediate coating material coated on said central core particle, said intermediate coating material comprising a hydrophobic oil material; and (iii) an external encapsulating material coated on said intermediate coating material, said external encapsulating material providing said laundry additive delivery particle with a substantially non-tacky surface; said external coating material comprising one or more at least partially wash soluble or dispersible compounds selected from the group consisting of carbohydrates, cellulose and cellulose derivatives, natural and synthetic gums, silicates, borates, phosphates, chitin and chitosan, water soluble polymers, fatty compounds, and mixtures thereof; and b) from about 50% to about 99.999% by weight of the composition of laundry ingredients selected from the group consisting of detersive surfactants, builders, bleaching agents, enzymes, soil release polymers, dye transfer inhibitors, fillers and mixtures thereof.

* * * * *